US009095200B2

(12) United States Patent
Heidenreiter

(10) Patent No.: US 9,095,200 B2
(45) Date of Patent: Aug. 4, 2015

(54) APPLICATOR DEVICE WITH A STRIPPING MEANS WHICH IS ADJUSTABLE BY WAY OF A CRUMPLE ZONE

(75) Inventor: Thomas Heidenreiter, Nuremberg (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 748 days.

(21) Appl. No.: 13/258,701

(22) PCT Filed: Mar. 24, 2010

(86) PCT No.: PCT/EP2010/001836

§ 371 (c)(1),
(2), (4) Date: Sep. 22, 2011

(87) PCT Pub. No.: WO2010/112163

PCT Pub. Date: Oct. 7, 2010

(65) Prior Publication Data

US 2012/0014738 A1 Jan. 19, 2012

(30) Foreign Application Priority Data

Apr. 1, 2009 (DE) ..... 20 2009 004 528 U

(51) Int. Cl.
*A45D 40/26* (2006.01)
*A45D 34/04* (2006.01)

(52) U.S. Cl.
CPC ..... *A45D 40/268* (2013.01); *A45D 34/047* (2013.01); *A45D 2200/052* (2013.01)

(58) Field of Classification Search
CPC . A45D 40/267; A45D 40/268; A45D 34/046; A45D 34/047
USPC ..... 401/121, 122
See application file for complete search history.

(56) References Cited

U.S. PATENT DOCUMENTS 4,194,848 A 3/1980 Kingsford
4,407,311 A * 10/1983 Gueret ..... 401/122

(Continued)

FOREIGN PATENT DOCUMENTS

DE 10226887 C1 12/2003
DE 60017530 T2 6/2005

(Continued)

*Primary Examiner* — David Walczak
*Assistant Examiner* — Bradley Oliver
(74) *Attorney, Agent, or Firm* — Bachman & LaPointe, P.C.

(57) ABSTRACT

An applicator device (10) for storing and applying a substance (20) to be applied, in particular a cosmetic substance, comprising: a container (30) for the substance having a container opening (32), an applicator implement (40), an adjustable stripping element (50) for the applicator implement, which is arranged at least partially in the region of the container opening, and an adjusting device for the action of the stripping means. The adjusting device (70) is formed by an actuating element (60) movable with respect to the stripping element for reversibly changing the stripping element, wherein the position of the actuating element is adjustable with respect to the stripping element by way of the adjusting device, and a crumple zone (34) in the container, by way of which the length of the container can be reversibly changed in the longitudinal direction, wherein the position of the actuating element is adjustable with respect to the stripping element by the change in length. The container substantially comprises an inner container casing (36) and an outer container casing (38), wherein the outer container casing (38) has the crumple zone (34) which is between a first outer container casing end (38*a*) and an open second outer container casing end (38*b*).

13 Claims, 5 Drawing Sheets

(56) References Cited

U.S. PATENT DOCUMENTS

| | | | | |
|---|---|---|---|---|
| 4,433,928 | A * | 2/1984 | Kingsford | 401/122 |
| 4,609,300 | A * | 9/1986 | Robert | 401/122 |
| 5,121,763 | A * | 6/1992 | Kingsford | 401/122 |
| 6,270,273 | B1 * | 8/2001 | Ohba | 401/122 |
| 6,945,723 | B1 * | 9/2005 | Gueret | 401/122 |
| 2003/0156885 | A1 | 8/2003 | Lee | |
| 2005/0252823 | A1 | 11/2005 | Roeder | |
| 2007/0141862 | A1 * | 6/2007 | Gueret | 439/66 |
| 2010/0104348 | A1 * | 4/2010 | Rauschert et al. | 401/122 |
| 2013/0004228 | A1 * | 1/2013 | Presche | 401/122 |

FOREIGN PATENT DOCUMENTS

| | | | |
|---|---|---|---|
| EP | 0002301 | A1 | 6/1979 |
| EP | 0002301 | B2 | 2/1987 |

* cited by examiner (State of the art) Fig. 1

APPLICATOR DEVICE WITH A STRIPPING MEANS WHICH IS ADJUSTABLE BY WAY OF A CRUMPLE ZONE

BACKGROUND OF THE INVENTION

The present invention concerns an applicator device for storing and applying a substance to be applied, in particular a cosmetic product. In addition the invention concerns a housing of variable length for such an applicator device.

Containers for substances to be applied, in particular cosmetic substances are known. In the case of such containers the applicator element when not in use frequently remains continuously dipped into the substance to be applied, in the interior of the container. For an application process it may be necessary to remove an excess of substance to be applied from a stick-shaped holding portion for an applicator element of the device, or an excess of substance on the applicator element, but nonetheless to leave a sufficient amount of substance to be applied on the applicator element, as is required for example for the application process. Particularly when the container is still new and thus substantially fully filled, under some circumstances too much substance may remain on the applicator element while conversely too little substance is on the applicator element when the content in the container is coming to an end.

To alleviate the above-indicated problem it is known in the state of the art for a through opening in a stripping element provided at the opening of the container for the applicator element to be designed to be variably adjustable in order to be able to meter the substance to be applied, to correspondingly different degrees, on the applicator element.

EP 0 002 301 B2 discloses a pack for cosmetics having a stripper device with at least one opening for stripping excess cosmetic composition from the applicator. The stripper device has an adjustment option, by means of which the opening of the stripper device can be varied. The range of variation is such that, at different settings, larger or smaller amounts of the cosmetic composition are removed from the applicator when the applicator is withdrawn from the container.

FIG. 1 shows an embodiment of the pack for cosmetics in EP 0 002 301 in a cross-sectional view, wherein the pack has a container comprising a first bottle 2*a* and a bottle sheath 2*b* movably connected thereto. The FIG. 1 container is partially filled with a cosmetic composition 5. Adaptation of the diameter of the stripper opening 9 can be achieved by rotation of the bottle 2*a* relative to the bottle sheath 2*b*. A brush as the applicator 6 is connected to a cap 3 by way of a stem 7 so that the cap serves at the same time as a handle for the applicator. The stripper device 10 comprises an integral ring which is fixed at the open end of the bottle 2*a* and has a stripper opening 9 at the inner end. In the region of the container opening the bottle sheath 2*b* has an annular edge 17 which extends into the interior of the container and which is arranged adjacent to the stripper device 10. For adjusting the diameter of the stripper opening, the arrangement has a male screwthread 14 in the outside wall of the bottle 2*a*, which fits into the inside wall of the bottle sheath 2*b* in relation to a corresponding female screwthread 15. Rotation of the bottle 2*a* relative to the bottle sheath 2*b*, without removal of the cap from the bottle sheath 2*b*, can move the bottle 2*a* together with the stripper device 10 along the longitudinal axis within the bottle sheath 2*b* to increase or reduce pressure on the stripper device 10 by way of the annular edge 17. The diameter of the stripper opening 9 is increased or reduced in accordance with the pressure on the stripper device 10 whereby the stripping action on a cosmetic composition with which the applicator 6 is loaded upon being withdrawn from the container can be adjusted.

A problem with the cosmetic pack known in the state of the art with an adjustable stripper device lies in sealing of the bottle 2*a* containing the cosmetic to be applied. In the cosmetic pack described in EP 0 002 301 sealing integrity is achieved by the arrangement and material property of the stripper device 10 insofar as the stripper device 10 is so arranged at the open end of the bottle 2*a* that at the same time it virtually performs a sealing function as an integrated O-ring seal between the bottle 2*a* and the bottle sheath 2*b* and thus safeguards the container against escape of the cosmetic contained therein. The dual function of the stripper device as a seal in the two-part pack cannot be eliminated as, to adjust the stripper device, the two housing parts, that is to say the bottle 2*a* and the bottle sheath 2*b*, have to be movable relative to each other. Thus the fit as between the two housing parts represents a permanent possible source of leakage, in particular for cosmetics with volatile constituents.

An object of the present invention is to improve the sealing integrity of the container which accommodates a filling material such as for example a pourable cosmetic substance, or to diminish measures necessary for that purpose. A further but also alternative object of the invention is that of developing or improving the adjustment option for the stripping means.

SUMMARY OF THE INVENTION

At least one of the foregoing objects is attained by an applicator device as described below. In addition the object in respect of the adjustment option is attained by a container for an applicator device having a variable length.

The applicator device according to the invention for storing and applying a substance to be applied, in particular a cosmetic product, comprises: a container which is open at least one end and which can receive the substance to be applied, having a container opening, an applicator implement having an applicator element, an adjustable stripping means arranged at least partially in the region of the container opening for at least a part of the applicator implement, and an adjusting device for the stripping means, by means of which the stripping action of the stripping means can be altered. The adjusting device for the stripping means is formed by an actuating means which is arranged movably with respect to the stripping means and which can reversibly change the stripping means. In that case the position or relative arrangement of the actuating means can be changed with respect to the stripping means by way of the adjusting device, insofar as a crumple zone is provided in the container, by means of which the length of the container means can be reversibly changed in the longitudinal direction. According to the invention the position of the actuating means is adjustable with respect to the stripping means by means of the change in length.

The container according to the invention, in particular for an applicator device according to the invention, substantially comprises two parts, preferably an inner container casing and an outer container casing. At least the inner container casing is intended to accommodate the substance to be applied and has a first inner container casing end and a second open inner container casing end. The outer container casing has a crumple zone which is between a first and an open second outer container casing end. The second inner container casing end and the second outer container casing end can open into the container opening or can merge thereinto. In order to form a container interior which in the final condition is accessible only by way of the container opening, either the first outer container casing end and the first inner container casing end can be arranged approximately in the same region, in which case the first inner container casing end has a closed end or alternatively can be closed with a cover or the like, or the first inner container casing end can be connected to the inner container casing (sealingly in positively locking relationship or in material-joining relationship) in a region between an end of the crumple zone, that faces towards the first outer container casing end and the first outer container casing end, in which case then the first outer container casing end can be closed with a cover or the like.

The crumple zone according to the invention in the container is preferably of a similar configuration to the fold structure of a concertina, that is to say like a bellows. In that way the crumple zone can be in the form of a tubular region which is elastic and/or which can be folded together in an "accordion-like" fashion. Alternatively the crumple zone can also be embodied by a material property and/or corresponding material weakenings.

In certain configurations the stripping means comprises a stripping element in the form of a flexible, in particular elastically deformable, diaphragm having at least one central bore as the at least one stripping opening. The diaphragm can be an integral component of the container or can be attached to the container. In the latter case the diaphragm can consist of a different material from the container; that can be achieved for example by a 2-plastic (P) injection molding process in which the diaphragm is formed from a soft/elastic plastic material on the container comprising a hard/stiff plastic material by injection molding thereto.

In certain configurations the actuating means is formed by an actuating sleeve or an actuating ring, the cross-section of which approximately corresponds to a desired maximum cross-sectional opening in the stripping opening. The actuating sleeve is therefore preferably arranged substantially with its through opening in aligned relationship with the stripping opening in the stripping means.

In certain embodiments the adjusting device comprises an adjusting sleeve having a first and a second open end, the crumple zone of the container preferably being arranged in the region of the adjusting sleeve. The first open end of the adjusting sleeve is coupled to the container rotatably with respect thereto in such a way that the adjusting sleeve is fixed with the first end to the container or is axially displaceable at least only in a longitudinal direction of the container. The second end of the adjusting sleeve is coupled in positively locking relationship to the region of the container having the container opening so that rotation of the adjusting sleeve with respect to the container is converted into a corresponding change in length by virtue of a reduction or increase in the length of the crumple zone.

The positively locking coupling between the second end of the adjusting sleeve and the region of the container having the container opening can be formed by mutually matched or adapted guide means on the outside surface of the container and the inside surface of the adjusting sleeve. For example the coupling can comprise a male screwthread on the container and a corresponding female screwthread on the adjusting sleeve. Alternatively coupling can be effected by a sliding guide which is arranged between the adjusting sleeve and the container and in which for example a guide projection is guided on one of the two parts in a corresponding sliding guide means on the other part. The sliding guide means can be formed for example by a groove which extends in one of the two parts, for example in the inside surface of the adjusting sleeve, or alternatively in the outside surface of the adjusting sleeve, in the form of a helix.

In particular configurations the container can be of a substantially two-part design comprising an inner container casing and an outer container casing. At least the inner container casing is provided for receiving the substance to be applied and has a first inner container casing end and an open second inner container casing end. The outer container casing has the crumple zone which is between a first and an open second outer container casing end. The open second inner container casing end and the open second outer container casing end form or open into the container opening. Depending on the respective configuration involved the stripping means can be disposed at the open first outer container casing end or at the first inner container casing end.

In certain configurations the actuating means is connected to a neck on the container opening or alternatively is in the form of an integral component of the container opening. Alternatively in certain configurations the actuating means can be connected to the second inner container casing end or can be in the form of an integral component thereof.

A first closure element can be provided at the container opening, said closure element being adapted to cooperate with a second closure element at or in the holding element as a closure device in such a way that the closure device is releasable after passage of the applicator element through the stripping means into the container by the cooperation of the first and second closure elements and the container can be sealingly closed for the substance to be applied.

The closure device is preferably provided at the container opening in the form of a screw closure, wherein there can be provided on the first and second closure elements in each case a corresponding female and male screwthread respectively corresponding to the other closure element.

The container and optionally the actuating means can be produced from a transparent material at least in a region in which the stripping means is disposed so that adjustment of the stripping element is possible visibly from the exterior.

In addition, a display corresponding to the adjustment of the stripping means, for example in the form of a line scale or another optical indicator, can be provided at the outside surface of the container, in which case the edge of the adjusting means that occurs in the display indicates the currently adjusted value. Alternatively the display can also be in the region under the adjusting means and can be visible to a user through an opening in the adjusting means or a viewing window.

Finally it should also be noted that one of the following, in particular cosmetic, substances can be contained in the container as the substance to be applied: a decorative cosmetic such as mascara, a lipstick, a lipliner, an eyeliner, eyeshadow or the like.

BRIEF DESCRIPTION OF THE DRAWINGS

Further advantageous configurations of the invention and an embodiment by way of example in respect thereof are described in greater detail hereinafter with reference to the accompanying drawing. The terms used in the description of the specific embodiment "left", "right", "top", "bottom" relate to the Figure in an orientation with the reference numerals and Figure identification being normally readable. The same references were used for the same or similar elements in the Figures. In the drawing.

DETAILED DESCRIPTION

Figure 1:
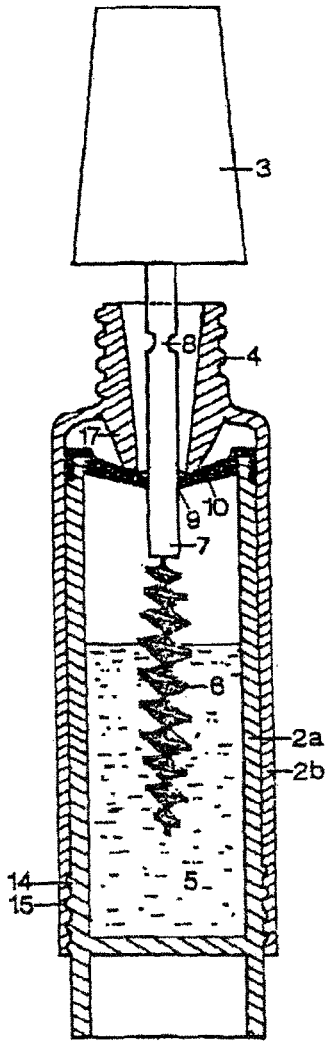
FIG. 1 shows a cross-sectional view of a pack for a cosmetic with an adjustable stripper device arranged in the container neck, according to the state of the art.
Figure 2:
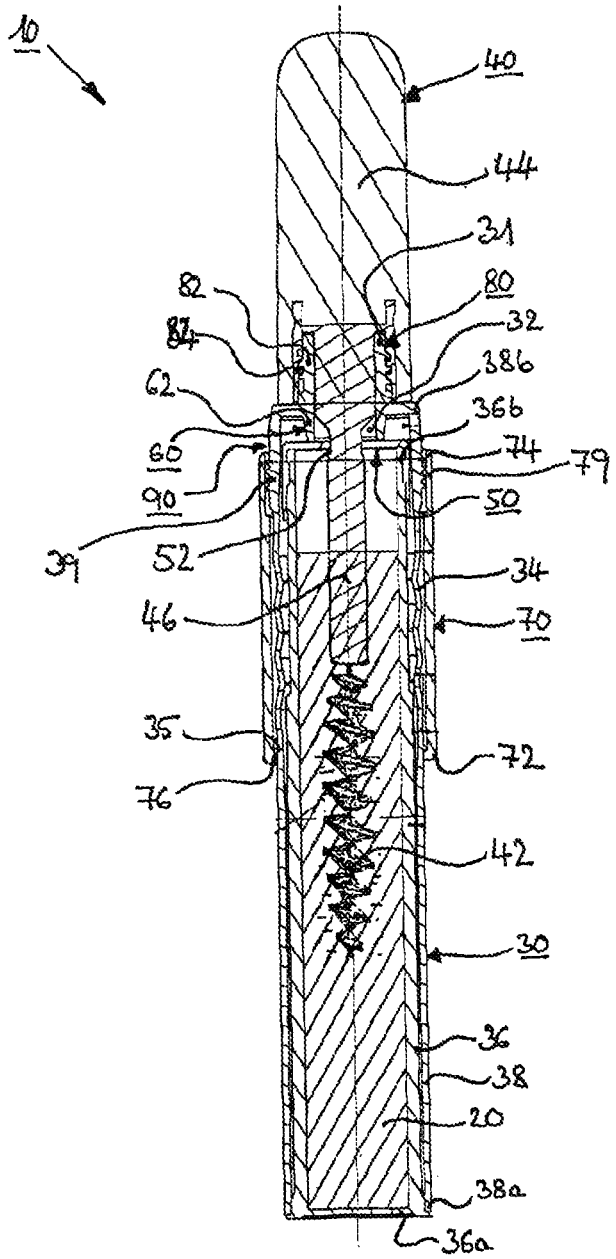
FIG. 2 shows a first embodiment of the present invention.

FIG. 2 shows a first embodiment of an applicator device 10 according to the invention in a cross-sectional view. The applicator device 10 is intended to store and apply a substance 20 to be applied. The substance is preferably a cosmetic product, in particular a decorative cosmetic such as for example a mascara, a lipstick, a lipliner, an eyeliner, eyeshadow or the like. To receive the substance 20 the applicator device 10 has a container 30 having a container interior for the substance 20, the container having at least one open end having a container opening 32.

There is also provided an applicator implement 40 in which a handle or gripping portion 44 is disposed at a first end of a possibly flexible stem 46, as a holding element for the applicator implement 40, for handling by a male or female user. A mascara brush is disposed as an applicator element 42 at the end of the stem 46, opposite to the gripping portion 44.

It should be noted that obviously any other configuration of an applicator instead of the brush can also be provided. The choice of the applicator is directly related to the substance to be applied and/or the surface to which the substance is to be applied. Mention will be made here only without any claim to completeness of small and large brushes, foam rubber applicators, 2-P applicators and the like.

An adjustable stripping means 50 is provided at least partially in the region of the container opening 32, at least one stripping opening 52 being provided in the stripping means 50. In that case the actual stripping function is performed by an edge at the stripping opening, wherein the stripping action is essentially determined by the cross-section of the stripping opening 52. The applicator element 42 on the holding element 44 can be passed through the stripping opening 52, by way of the stem-like connecting element 46. That is effected on the one hand when removing substance to be applied, that is to say when withdrawing the applicator element 42 from the container 30, or on the other hand when closing the applicator device 10 after an application process by inserting the applicator element 42 into the interior of the container 30 through the stripping opening. Provided for the stripping means 50 is an adjusting device, by means of which the stripping means 50 can be deformed and shaped in order to alter or adjust the cross-section of the at least one stripping opening 52 and therewith the stripping action.

The adjusting device according to the invention is formed by an actuating means 60 arranged movably with respect to the stripping means 50. In the FIG. 2 embodiment the actuating means 60 is in the form of an annular actuating sleeve 62 arranged adjacent to the stripping means 50. Preferably the stripping means 50 is formed by a flexible diaphragm which for example comprises an elastically deformable or stretchable material and in which the stripping opening is disposed substantially centrally in the form of a through bore or orifice so that the diaphragm can be deformed by stretching by way of the actuating means in such a way that the stripping opening 52 in the diaphragm can be correspondingly increased or widened or reduced or narrowed. Preferably the actuating means can reversibly deform the stripping means in a direction substantially perpendicular to the stripping opening 52.

A male or female user can adjust the position of the actuating means 60 with respect to the stripping means 50 by the adjusting device, in which case, in the FIG. 2 embodiment, adjustment is achieved by altering the relative position or arrangement of the actuating means 60 with respect to the stripping means 50. For that purpose the container 30 has the above-mentioned accordion-like crumple zone 34 in the manner of a bellows, by means of which the axial length of the container 30 can be reversibly changed in the longitudinal direction by being folded or crumpled together. According to the invention the position of the actuating means with respect to the stripping means is adjusted by way of that change in length in the crumple zone 34 according to the invention of the container 30.

The actuating means 60 in the illustrated embodiment of the applicator device 10 is formed by an annular actuating sleeve 62, the cross-section of which approximately corresponds to the desired maximum cross-sectional opening of the stripping opening 52. For that purpose the actuating means 60 or the actuating sleeve 62 is advantageously connected to a neck 31 at the container opening 32 of the container 30 or is in the form of an integral component of the preferred neck 31, in which case the actuating means extends into the interior of the container 30 in the form of a substantially peripherally extending edge in the axial direction of the container opening.

The adjusting device according to the invention comprises an adjusting sleeve 70 having a first open adjusting sleeve end 72 and a second open adjusting sleeve end 74. The crumple zone 34 is arranged between those first and second open ends of the adjusting sleeve 70 below same and is integrated into the outer container casing. In that way the crumple zone 34, when the adjusting sleeve 70 is made from a non-transparent, that is to say opaque material, is not visible for a male or female user from the exterior.

The first end of the adjusting sleeve 72 is coupled to the container 30 rotatably with respect thereto so that the adjusting sleeve is axially displaceable not at all or only in one of the two possible axial directions, that is to say longitudinal directions, of the container 30 with respect thereto and along same. Preferably this involves that one of the two axial directions that is directed away from the container opening 32. For that purpose provided on the container is a suitable guide or a container abutment 35 cooperating with a corresponding guide or an adjusting sleeve abutment 76 on the adjusting sleeve 70.

In addition the second end 74 of the adjusting sleeve 70 is positively lockingly coupled to the region of the container 30 having the container opening 32 in such a way that rotation of the adjusting sleeve 70 with respect to the container 30, by virtue of the cooperation of the male screwthread 39 on the container 30 and the female screwthread 79 on the adjusting sleeve 70, causes or results in a corresponding reduction in length or elongation of the crumple zone 34.

The positively locking coupling between the second end of the adjusting sleeve 70 and the region of the container 30 having the container opening 32 is implemented in the FIG. 2 embodiment by a male screwthread 39 on the container 30 and a corresponding female screwthread 79 on the adjusting sleeve 70. It should be noted that other suitable shapes and configurations of a positively locking coupling between the container outside and the adjusting sleeve inside, which convert a rotary movement of the adjusting sleeve 70 into a corresponding axial movement of the part of the container 30, that is coupled to the adjusting sleeve 70, are also possible. By way of example the adjusting sleeve 70 and the outside of the container 30 can be coupled by means of a sliding guide disposed therebetween.

The container 30 of the applicator device 10 according to the invention as shown in FIG. 2 is formed substantially from an inner container casing 36 and an outer container casing 38. The inner container casing 36 forms the part of the container that is provided to accommodate the substance 20 to be applied and has a first closed inner container casing end 36*a* and a second open inner container casing end 36*b*. At the second, that is to say open, inner container casing end 36*b* the stripping means 50 is arranged in the form of the flexible diaphragm. The outer container casing 38 has a first 38*a* and a second 38*b* open outer container casing end, the crumple zone 34 according to the invention being arranged therebetween.

The inner container casing 36 and the outer container casing 38 when assembled form the container 30. In the illustrated assembled condition the open second inner container casing end 36*b* is in the same region as the open second outer container casing end 38*b*. The open first outer container casing end 38*a* is in the same region as the closed first inner container casing end 36*a*, wherein in the assembled condition of the applicator device 10 those ends can be joined together in positively locking relationship and/or material-locking relationship or in any other suitable fashion for example by gluing, welding or the like non-releasably and thus in sealing relationship for the substance contained in the container.

The bottle neck 31 at the container opening 32 has a first closure element in the form of a male screwthread 82 which is adapted or designed to cooperate with a matching female screwthread 84 at the holding element 44 as the second closure element in such a way that, after the applicator element 42 has been passed through the stripping means 50, the container 30 can be closed releasably and preferably sealingly for the substance 20 to be applied, by corresponding cooperation of the two screwthreads 82, 84.

In other words, the FIG. 2 closure device at the container opening 32 is in the form of screw closure, in which respect it is clear to the man skilled in the art that alternative closure devices can equally be used. For example it is alternatively possible to use force-locking plug connections or positively locking connections such as a bayonet closure or the like.

In a preferred development of the applicator device 10 according to the invention the container 30 and optionally the adjusting sleeve 70 are made from a transparent material at least in the region in which the stripping means 50 and the actuating means 60 are disposed so that a male or female user of the applicator device 10 can set the adjustment of the stripping means 50, that is to say the setting of the effective cross-sectional opening in the stripping means, from the exterior in directly visible fashion by means of visual checking when actuating the adjusting means.

Figure 4A:
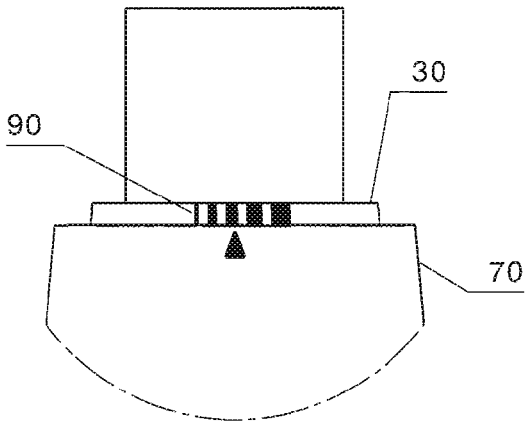
FIGS. 4*a*, 4*b* and 4*c* show a display in the form of an optical indicator.
Figure 4B:
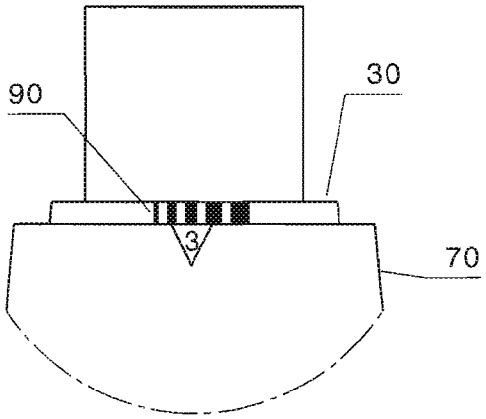
Figure 4C:
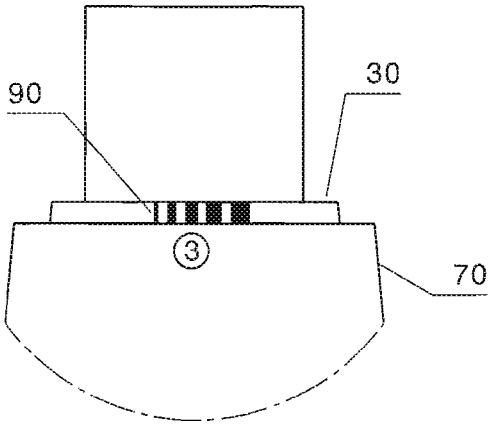

In addition, as shown in FIGS. 4*a*, 4*b* and 4*c*, provided at the outside surface of the container 30 is a display 90 corresponding to the adjustment of the stripping means 50, for example in the form of a line scale or another optical indicator. The edge which appears in the display of the second open adjusting sleeve end 74 thus shows the currently set value which substantially corresponds to the set cross-section of the stripping opening 52. It will be appreciated that as a further alternative the display can also be provided in the region under the adjusting sleeve 70, in which case then the display can be visible to a user through an opening or a transparent viewing window in the adjusting sleeve, for example with reference to the degree of folding of the crumple zone 34.

Finally the adjusting procedure according to the invention for the action of the stripping means is to be briefly described here. In that respect it is to be noted that basically the actual adjustment of the cross-section of the stripping opening in the stripping means is known from the state of the art already referred to in the opening part of this specification. The applicator device according to the invention essentially differs from the state of the art by improved sealing integrity of the container accommodating the substance to be applied and the adjusting principle which is further proposed in accordance with the invention by way of the crumple zone 34 on the container 30.

A male or female user of the applicator device can now adjust the stripping means 50 by gripping the container at the end opposite the holding portion 44 and turning the adjusting sleeve 70 in one of the two possible directions of rotation with respect to the container 30. That rotary movement is converted by way of the coupling of the adjusting sleeve 70 to the container 30 into stretching or upsetting of the crumple zone 34 of the container 30 and thus a corresponding change in length of the container. In that way, in accordance with that stretching or upsetting effect, the actuating means 60 in the form of the actuating sleeve 62 is urged in the direction of the interior of the container 30 against the stripping means 50 or upon reversed actuation of the adjusting sleeve is removed in a direction away from the interior of the container 30 away from the adjusting means 50. Thus a rotary movement of the adjusting sleeve 70 is converted directly into a corresponding adjustment of the effective cross-section of the stripping opening 52 of the stripping means 50.

Figure 3A:
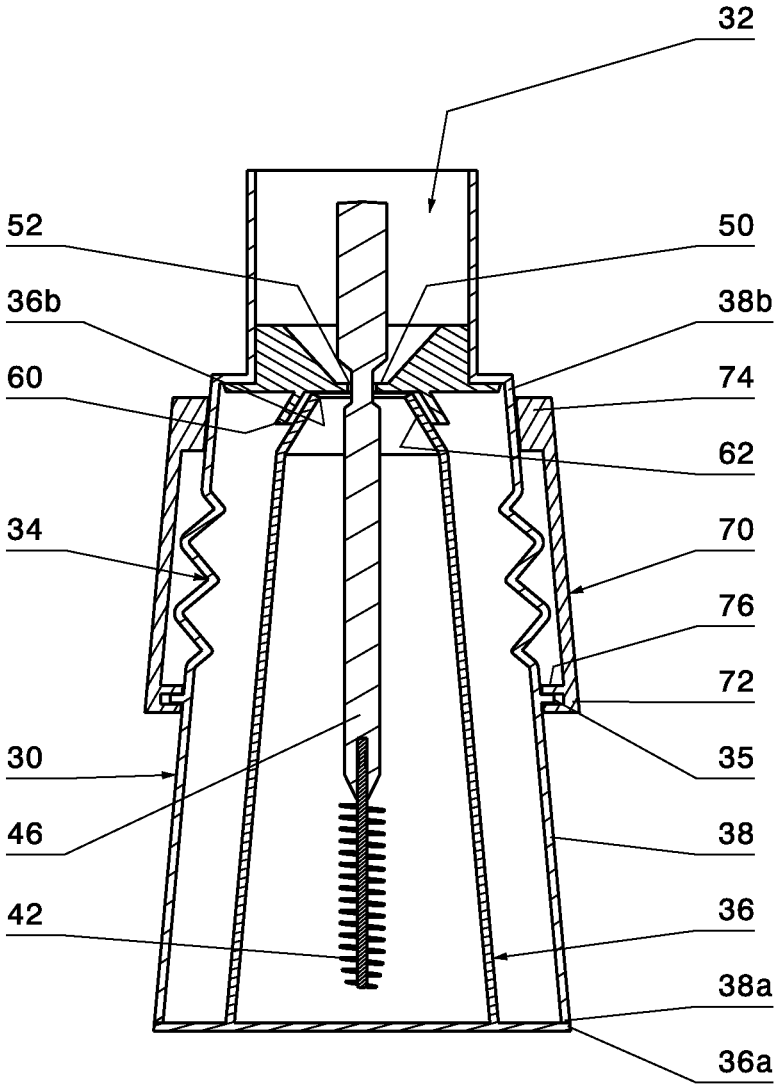
FIG. 3*a* shows a second embodiment of the present invention.
Figure 3B:
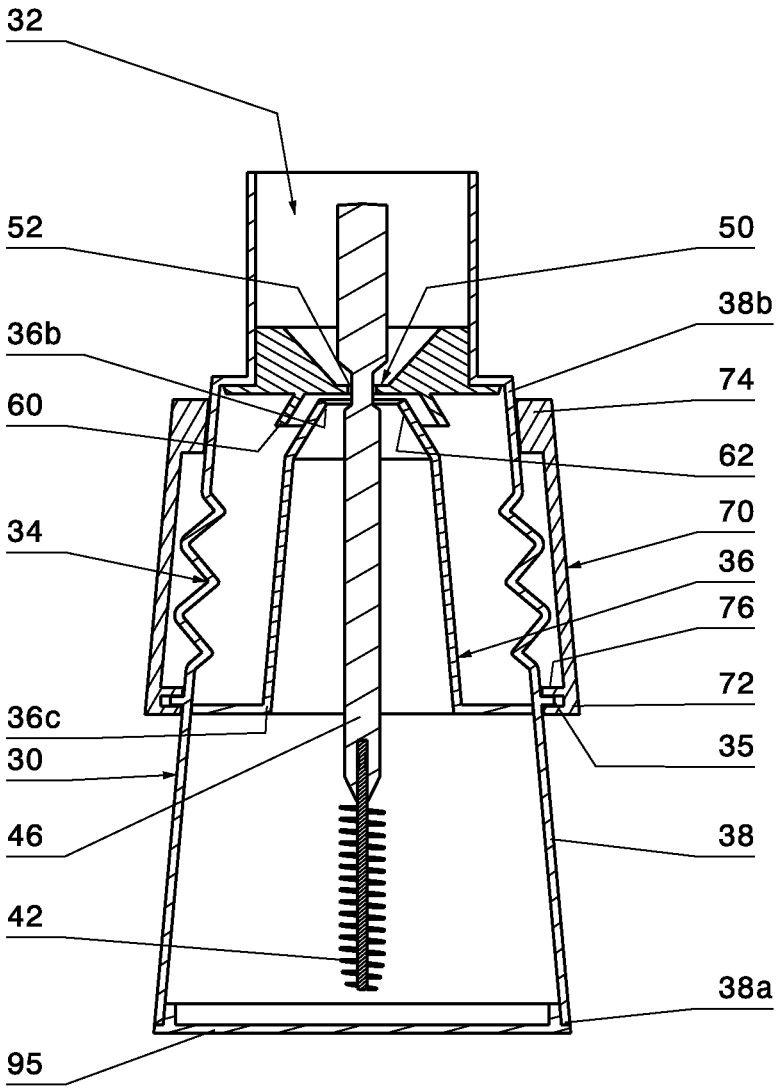
FIG. 3*b* shows an alternative configuration of the second embodiment.

A second embodiment as shown in FIG. 3*a* as well as a modification thereof as shown in FIG. 3*b* will be described hereinafter, in which respect only the essential differences in relation to the first embodiment of FIG. 2 will be discussed here.

The essential difference in the second embodiment relative to the first embodiment in FIG. 2 is that the actuating means 60 is provided on the second inner container casing end 36*b* by being connected thereto or by being in the form of an integral component thereof. The adjustable stripping means 50 in the form of the diaphragm having the at least one stripping opening 52 is arranged in the container opening 32 or in the region of the open second end 38*b* of the outer container casing 38 so that the actuating means 60 is in the interior of the container 30 opposite the stripping means 50 in comparison with the FIG. 2 embodiment.

The actuating principle of the adjusting option for the stripping means of the second embodiment corresponds to that of the first embodiment, but actuation and thus adjustment of the action of the stripping means 50 is effected from the direction from the interior of the container, wherein the change in length of the container 30 leads to a change in the position of the stripping means 50 with respect to the actuating means 60.

FIG. 3*b* shows an alternative configuration of the second embodiment. Instead of a closed first end (in FIG. 2 and FIG. 3*a*) the inner container casing 36 has an open first end 36*c* which is connected outside the crumple zone to the outer container casing 38 in which the crumple zone 34 is disposed, more specifically to or in the subregion of the outer container casing at which the open first outer container casing end 38*a* is disposed. The container end which is opposite the container opening 32, that is to say the first outer container casing end 38*a*, is closed by means of a cover 95 or a cap or the like. In this embodiment the inner container casing can be shorter, wherein the open inner container casing end ends for example where the actuating sleeve 70 is fixed to the outer container casing.

The invention claimed is:

1. An applicator device (10) for storing and applying a substance (20) to be applied, in particular a cosmetic product, wherein the applicator device comprises:

a container (30) which is open at at least one end and which can accommodate the substance to be applied, having a container opening (32), an applicator implement (40) having an applicator element (42), an adjustable stripping means (50) for at least a part of the applicator implement, which is arranged at least partially in the region of the container opening, and an adjusting device for the stripping means by means of which the stripping action of the stripping means can be altered, wherein the adjusting device (70) is formed by an actuating means (60) which is arranged movably with respect to the stripping means and which can reversibly change the stripping means, wherein the position of the actuating means is adjustable with respect to the stripping means by way of the adjusting device, and a crumple zone (34) of the container, by means of which the length of the container can be reversibly changed in the longitudinal direction, wherein the position of the actuating means is adjustable with respect to the stripping means by means of the change in length, the stripping means (50) comprises a stripping element in the form of a flexible and/or elastically deformable disc-shaped diaphragm having at least one central bore as at least one stripping opening, and the adjusting device for the stripping means (50) is adapted to reversibly deform the diaphragm by way of the actuating means (60) in a direction substantially perpendicular to the stripping opening, wherein the cross-section of the at least one stripping opening is correspondingly adjustable.

2. An applicator device as set forth in claim 1 wherein the applicator implement (40) has a connecting element (46), at one end of which is arranged the applicator element (42) and at the other end of which is arranged a holding element (44), wherein the connecting element (46) connects the applicator element to the holding element.

3. An applicator device as set forth in claim 2 wherein provided at the container opening (32) is a first closure element (82) adapted to cooperate with a second closure element (84) at the holding element (44) as a closure device (80) in such a way that the container (30) is closable releasably and sealingly for the substance (20) to be applied after a passage of the applicator element (42) through the stripping means (50) by the cooperation of the first and second closure elements, and wherein the closure device (80) is formed at the container opening (32) in the form of a screw closure, wherein respectively provided at the first (82) and second (84) closure element is a corresponding female and male screwthread respectively corresponding to the other closure element.

4. An applicator device as set forth in claim 1 wherein the adjusting device has an adjusting sleeve (70) having a first (72) and a second (74) open end, wherein the crumple zone (34) is arranged in the region of the adjusting sleeve, wherein the first end (72) of the adjusting sleeve is coupled to the container (30) rotatably with respect thereto in such a way that the first end (72) is fixed to the container or is axially displaceable at least only in a longitudinal direction of the container, and wherein the second end of the adjusting sleeve is positively lockingly coupled to the region of the container having the container opening (32) in such a way that rotation of the adjusting sleeve with respect to the container is converted into a corresponding change in length by a reduction in length or stretching of the crumple zone.

5. An applicator device as set forth in claim 4 wherein the positively locking coupling between the second end of the adjusting sleeve and the region of the container having the container opening is formed by a male screwthread (39) on the container (30) and a corresponding female screwthread (79) on the adjusting sleeve (70), or a sliding guide arranged between the adjusting sleeve and the container.

6. An applicator device as set forth in claim 1 wherein the container (30) substantially comprises an inner container casing (36) and an outer container casing (38), wherein at least the inner container casing (36) is provided to accommodate the substance (20) to be applied and has a first inner container casing end (36*a*) and an open second inner container casing end (36*b*), wherein the outer container casing (38) has the crumple zone (34) which is between a first (38*a*) and an open second (38*b*) outer container casing end, and wherein the open second inner container casing end (36*b*) and the open second outer container casing end (38*b*) form or open into the container opening (32), and wherein the stripping means is arranged at the open first outer container casing end (38*a*) or at the first inner container casing end (36*a*).

7. An applicator device as set forth in claim 6 wherein the actuating means is connected to a neck (31) at the container opening (32) or is in the form of an integral component thereof.

8. An applicator device as set forth in claim 6 wherein the actuating means is connected to the second inner container casing end (36*b*) or is in the form of an integral component thereof.

9. An applicator device as set forth in claim 6 wherein the actuating means (60) comprises an actuating sleeve (62) or an actuating ring.

10. An applicator device as set forth in claim 6, wherein either the first inner container casing end (36*a*) is a closed end or the first inner container casing end (36*a*) is connected to the outer container casing in a region between an end of the crumple zone that faces towards the first outer container casing end (38*a*) and the first outer container casing end (38*a*) and the first outer container casing end (38*a*) is closed with a cover (95).

11. An applicator device as set forth in claim 1 wherein provided at the outside surface of the container (30) is a display (90) corresponding to the adjustment of the stripping means in the form of a line scale or another optical indicator, and wherein the edge of the adjusting means, which occurs in the display, displays the currently adjusted value.

12. An applicator device as set forth in claim 1 wherein provided at the outside surface of the container (30) is a display (90) corresponding to the adjustment of the stripping means in the form of a line scale or another optical indicator, and wherein the display is disposed in a region under the adjusting means and is visible from the exterior through an orifice or a transparent viewing window in the adjusting means.

13. An applicator device as set forth in claim 1 wherein the substance in the container (30) is selected from the group consisting of a mascara, a lipstick, a lipliner, an eyeliner, and an eyeshadow.

* * * * *